US005743677A

United States Patent [19]

Phillips et al.

[11] Patent Number: 5,743,677

[45] Date of Patent: Apr. 28, 1998

[54] SUBSEA MULTI-SEGMENTED PILE GRIPPER

[75] Inventors: Darron J. Phillips, Arlington; William J. Eldridge, Grand Prairie; Larry V. Spalding, Fort Worth, all of Tex.

[73] Assignee: Oil States Industries, Inc., Arlington, Tex.

[21] Appl. No.: 624,170

[22] Filed: Mar. 29, 1996

[51] Int. Cl.[6] ..... E02B 17/02

[52] U.S. Cl. ..... 405/227; 405/199

[58] Field of Search ..... 405/199, 225, 405/227, 224; 267/150, 157, 161; 285/340

[56] References Cited

U.S. PATENT DOCUMENTS

| | | | |
|---|---|---|---|
| 2,830,788 | 4/1958 | Bentley et al. . | |
| 2,873,580 | 2/1959 | Suderow . | |
| 2,934,804 | 5/1960 | Suderow . | |
| 3,844,002 | 10/1974 | Slemmons | 24/263 DH |
| 3,899,865 | 8/1975 | Revaz | 53/234 |
| 4,052,861 | 10/1977 | Malone et al. | 61/86 |
| 4,318,640 | 3/1982 | Schiemichen et al. | 405/199 |
| 4,389,140 | 6/1983 | Bordes | 405/195 |
| 4,408,932 | 10/1983 | Cowan | 405/227 |
| 4,934,869 | 6/1990 | Brandon et al. | 405/199 |
| 5,035,542 | 7/1991 | Bassett | 405/227 |

OTHER PUBLICATIONS

"Pile Gripper" brochure No. OSI 650, Oil States Industries, Arlington, Texas, 1994.

"Diaphragm Closures" brochure No. OSI 623, Oil States Industries, Arlington, Texas, 1994.

"Flexiflood System" brochure No. OSI 628, Oil States Industries, Arlington, Texas, 1986.

*Primary Examiner*—Tamara L. Graysay

*Assistant Examiner*—Frederick L. Lagman

*Attorney, Agent, or Firm*—Arnold,White & Durkee

[57] ABSTRACT

A pile gripper which uniformly engages a plurality of gripper teeth against a pile during engagement and uniformly retracts those same gripper teeth during disengagement is described. In one embodiment, the pile gripper is comprised of a an elastomeric bag, a plurality of segments arranged circumferentially on the pile-side of the gripper's structure, and a plurality of segment retraction elements. Each segment has a plurality of teeth which are used to "grip" an anchor pile. Segment teeth direction may alternate from segment to segment or segment group to segment group. Each segment group comprises a plurality of N segments, and each segment in a segment group is operatively coupled via grouping bars to the other segments in the segment group. The combination of uniform segment teeth movement during both engagement and disengagement provides significantly more load bearing capability for a specified gripper assembly length or, alternatively, a significantly shorter gripper assembly for a specified load bearing capability than prior art grippers.

22 Claims, 12 Drawing Sheets

FIG. 8b
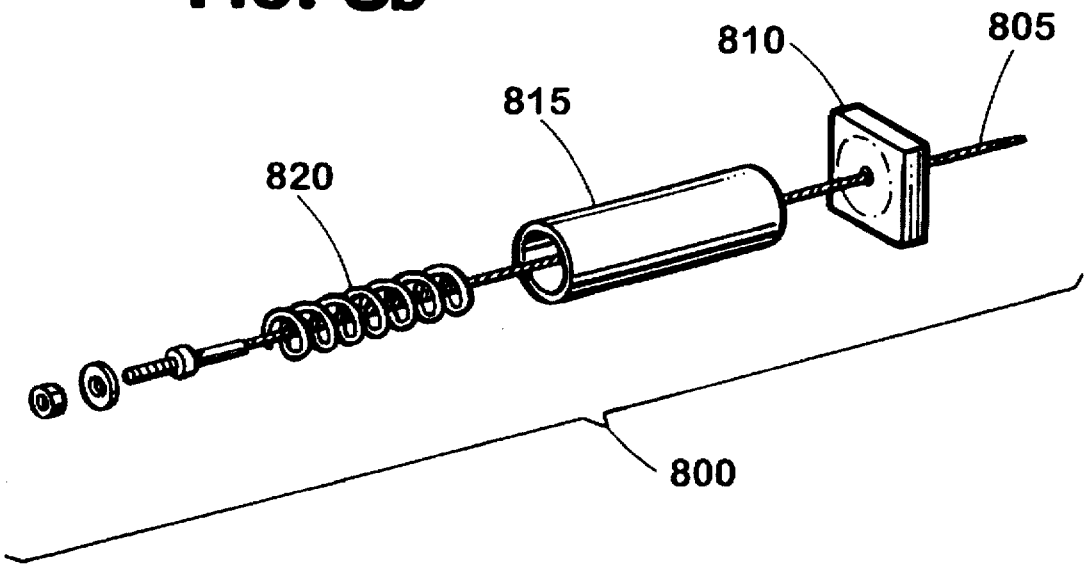
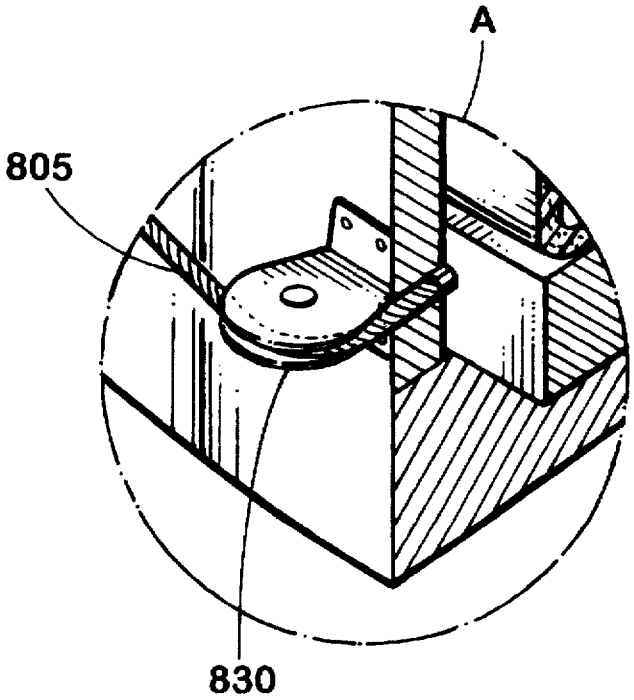
FIG. 8c

SUBSEA MULTI-SEGMENTED PILE GRIPPER

1. BACKGROUND OF THE INVENTION

The invention relates in general to a gripper assembly for use with land or marine columns, poles, caissons, posts, and the like. Specifically, there is described a multi-segmented pile gripper which is pneumatically engaged/activated and disengaged/deactivated via a mechanism which uniformly retracts the gripper's teeth.

During the installation of offshore platforms and similar structures, there is a need to secure the platform to the ocean floor. See FIG. 1*a*. Typically, the jacket 130 is lowered to the ocean floor 110. Attached to the ocean floor end of each jacket leg 105 is a hollow pile sleeve 115 and affixed to each sleeve 115 is a pile gripper 120. The pile gripper may be attached to the top, bottom, or middle of the sleeve. Piles 125, or anchors, are driven down through the hollow sleeve/gripper combination and into the ocean floor 110. When activated, the pile gripper 120 mechanically grips the pile. In this manner the pile gripper 120 mechanically locks the jacket 130 (comprised of the legs 105, pile sleeve 115, pile gripper 120, and pile 125) to the ocean floor. Later, cement or other binder can be injected into the pile sleeve 115, between the sleeve and the pile 125, to permanently fix the jacket 130 to the ocean floor 110. At this point the pile gripper is deactivated. A cross section view of the pile sleeve 115, pile gripper 120 combination is shown in FIG. 1*b*.

The mechanical lock provided by a pile gripper 120 is generally required to be achieved and released a number of times depending upon the circumstances in which the gripper is to be used. For instance, a pile gripper may be engaged/activated to mechanically lock the jacket during platform installation and later (but before the region between the pile sleeve 115 and the pile 125 is filled with cement) released to allow the platform to be leveled. Several types of subsea grippers have been used to provide the necessary mechanical lock, although they are typically very large and expensive, unreliable, or are unable to engage, release, and reengage.

A first type of prior art gripper mechanism is comprised of a group of hydraulic cylinders radially spaced and mounted in a steel can and welded to a platform leg or sleeve. The hydraulic cylinders are powered by a hydraulic pump at the surface of the offshore platform and are connected via supply lines to the gripper mechanism. As described above, an anchor or pile is driven through the middle of the sleeve/gripper mechanism and into the ocean floor. A mechanical lock is achieved by applying hydraulic pressure via the cylinders forcing the head of the cylinders, which have a plate with tooth rows, towards the anchor pile. Once contact is made between the anchor pile and the cylinder head's teeth, the cylinder head deforms the pile locally around the point of contact creating a flat spot on the curved anchor surface from the gripper head plate in contact with the pile. Drawbacks to this type of gripper include its extensive use of surface support equipment including hydraulics, the use of multiple hydraulic cylinders having a large number of mechanical connections, and the inability to withstand transient side loads (e.g., due to large wave action).

A second type of prior art gripper mechanism comprises gripper wedges which have serrated inner surfaces and angled outer surfaces located in an annular cavity and welded to the platform leg or sleeve. In operation, the anchor pile is driven through the middle of the sleeve or gripper mechanism and into the ocean floor. A gripper wedge is driven downward by either a power screw or hydraulic cylinder mounted on the outside of the leg or sleeve forcing the gripper wedge toward the anchor pile. Once the gripper wedge comes in contact with the anchor pile a mechanical lock is achieved. Drawbacks to this type of prior art gripper include those cited above for the first type of prior art gripper and its limited range of movement during engagement operations.

A third type of prior art gripper mechanism has one or two cylinders slotted longitudinally from within a couple of inches of one end all the way to the other end, thereby forming cantilever beam-like fingers. The slotted cylinder is inserted inside another cylinder and both cylinders are welded to a ring having an inner diameter equal to that of the slotted cylinder. The first one to three feet of fingers, from the free end, in the slotted cylinder have their inner surface machined to form sharp edges making circumferential tooth rows. There is an elastomeric bladder placed between the outer cylinder and the fingers behind the tooth rows which, when inflated, push the slotted fingers inward towards the center of the cylinder. This gripping mechanism is welded to the leg or sleeve on the bottom of the ring which joins the two cylinders. An anchor pile is inserted through the center of the sleeve and driven into the ocean floor. The gripper's elastomeric bladder is connected to inflation tubing which runs to the surface. The gripper mechanism is activated by applying pneumatic pressure via the tubing, inflating the elastomeric bag, and pushing the fingers towards the anchor in a cantilever type action. The fingers' teeth engage the anchor and restrain the jacket from movement. Drawbacks to this type of gripper include its expense and size. Specifically, the use of cantilever beam fingers requires a relatively long gripper finger in order to reduce the material stress at the point where the fingers are welded to the gripper ring.

2. SUMMARY OF THE INVENTION

A multi-segmented pile gripper in accordance with the invention is a mechanical device which uniformly engages a plurality of gripper teeth against a pile during engagement and uniformly retracts those same gripper teeth during disengagement. The combination of uniform segment teeth movement during engagement and disengagement provides significantly more load bearing capability for a specified gripper assembly length or, alternatively, a significantly shorter gripper assembly for a specified load bearing capability than prior art grippers. A gripper in accordance with the invention provides jacket stability during platform installation, and bottom and storm safeing.

In one embodiment, the pile gripper is comprised of a pair of extension rings, a pair of base rings, a hollow containment cylinder, a plurality of spring elements, an elastomeric bag, and a plurality of segment groups arranged circumferentially on the pile side of the containment cylinder. Each segment group comprises a plurality of N segments, and each segment has a plurality of teeth which are used to "grip" an anchor pile. Each segment in a segment group is operatively coupled via grouping bars to the other segments in the segment group. Teeth direction alternates from segment to segment or from segment group to segment group. Conceptually, the totality of segment groups form a segmented ring. When the elastomeric bag is inflated, it exerts pressure on the backside of the segmented ring, forcing it to move uniformly inward and compress radially to grip the pile. When the elastomeric bag is deflated, the spring elements uniformly retract the segments comprising the segmented ring to disengage the pile gripper. The elastomeric bag functions as an engagement device disposed between the hollow containment cylinder and the segment groups, and the spring elements function as a retraction mechanism.

In alternative embodiments, the aforementioned spring elements are located in various positions and/or replaced by tie rods and a second elastomeric bag. Additionally, multiple elements of the gripper's structure can be machined from a single metal ring.

3. BRIEF DESCRIPTION OF DRAWINGS

FIG. 1*a* is pictorial representation of an offshore platform using pile gripper technology for stability. FIG. 1*b* is a cross section view of the leg, pile, sleeve, and pile gripper denoted by symbol 'A' in FIG. 1*a*.

Figure 7:
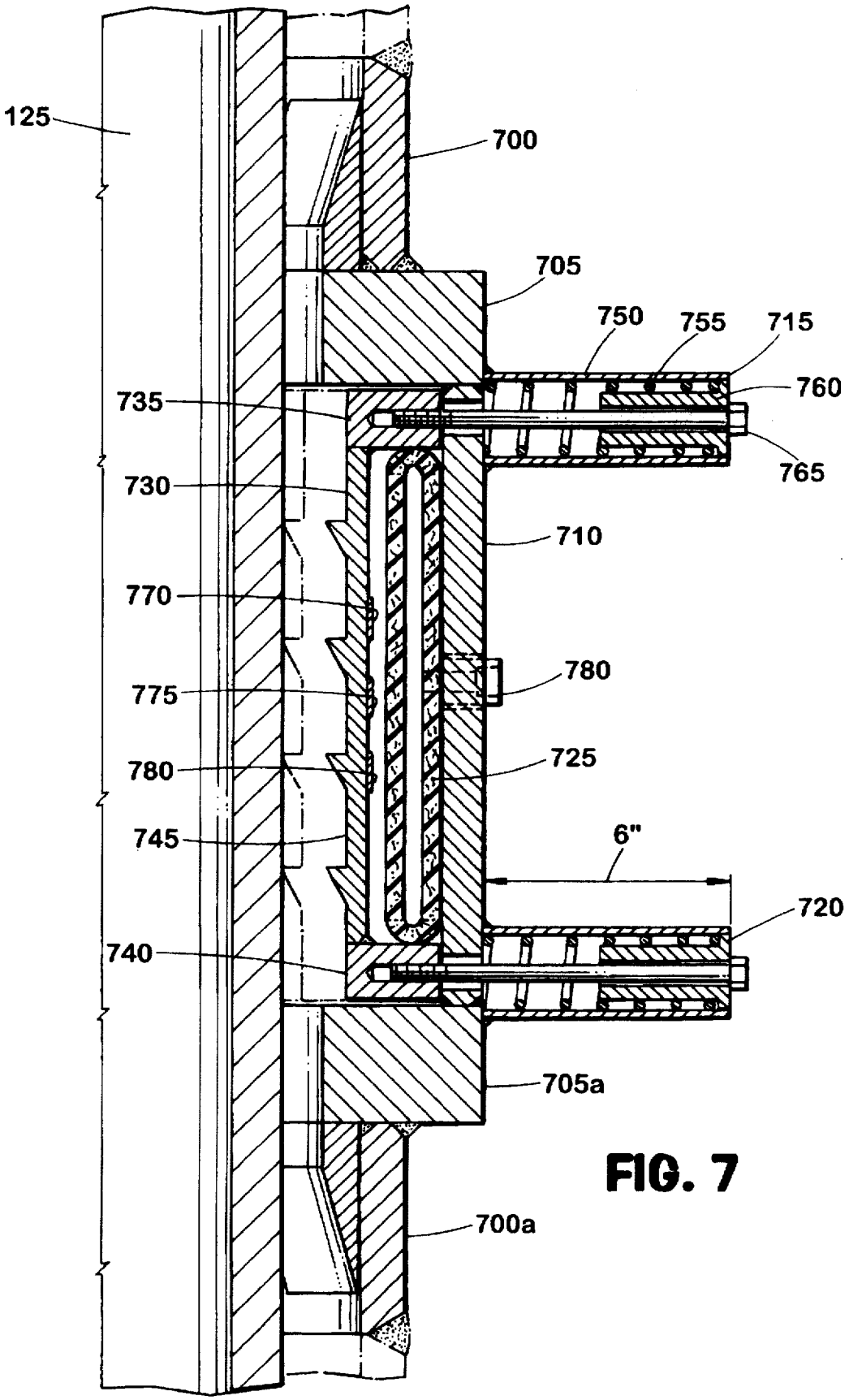
FIG. 7 shows, in cross section, a detailed view of a single segment of a pile gripper in accordance with the invention.
Figure 8A:
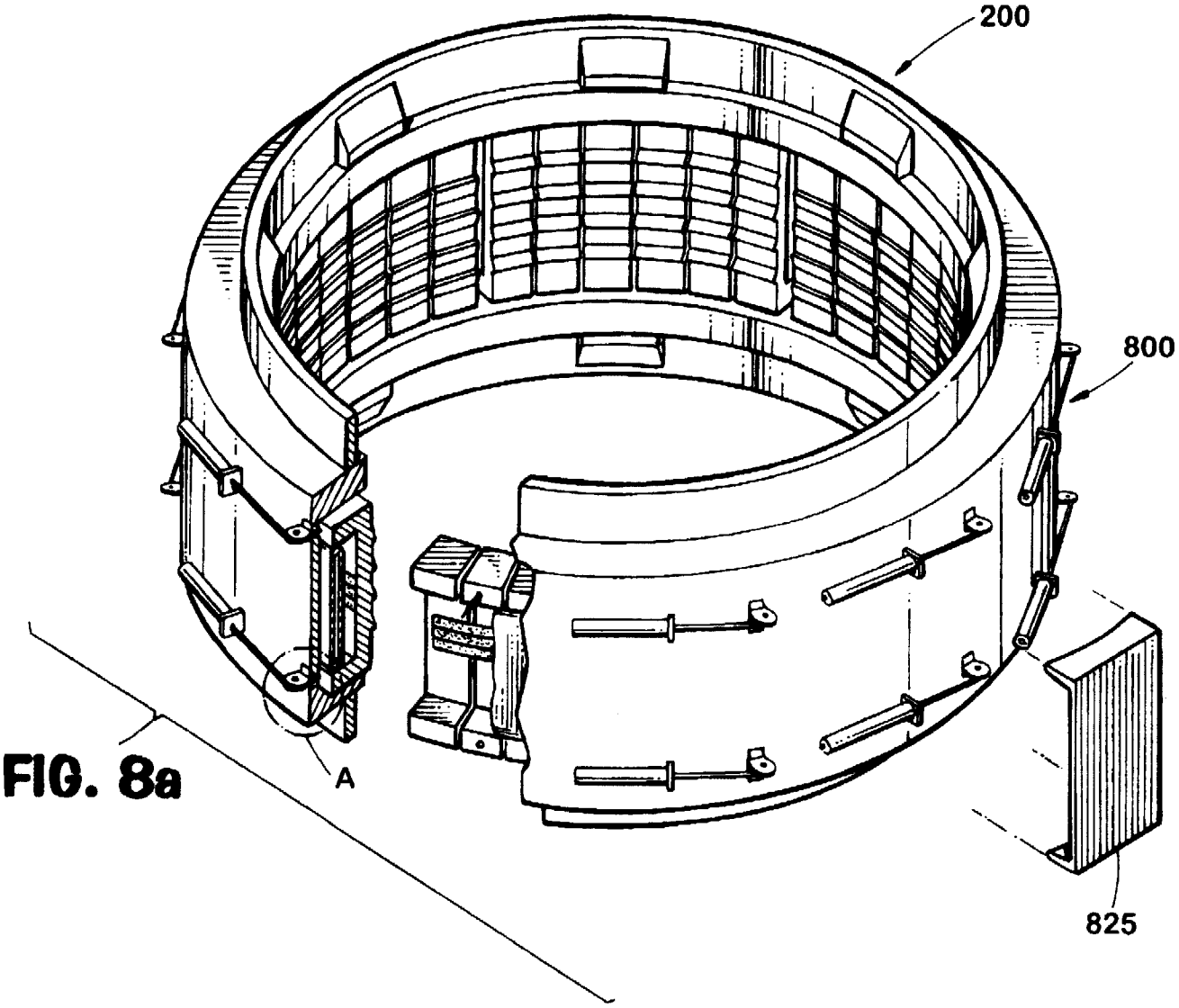

FIG. 8*a* shows an isometric view of a pile gripper in accordance with the invention that uses cable assemblies in place of the spring elements of FIG. 7. FIG. 8*b* shows an expanded view of the cable assemblies' retraction mechanism, and FIG. 8*c* shows an expanded view of the cable assembly as it is angled by a pulley.

Figure 9B:
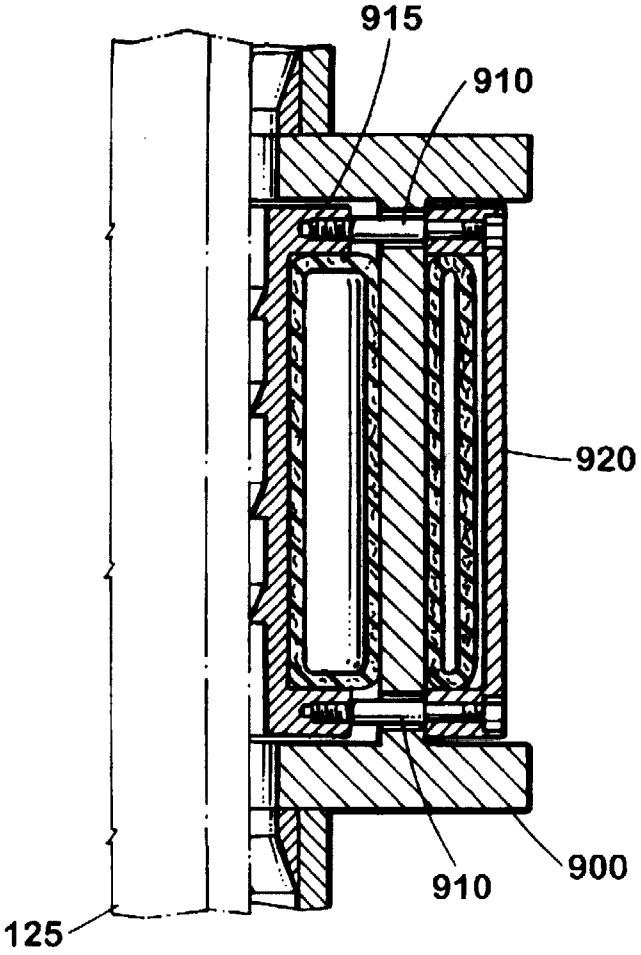
Figure 9A:
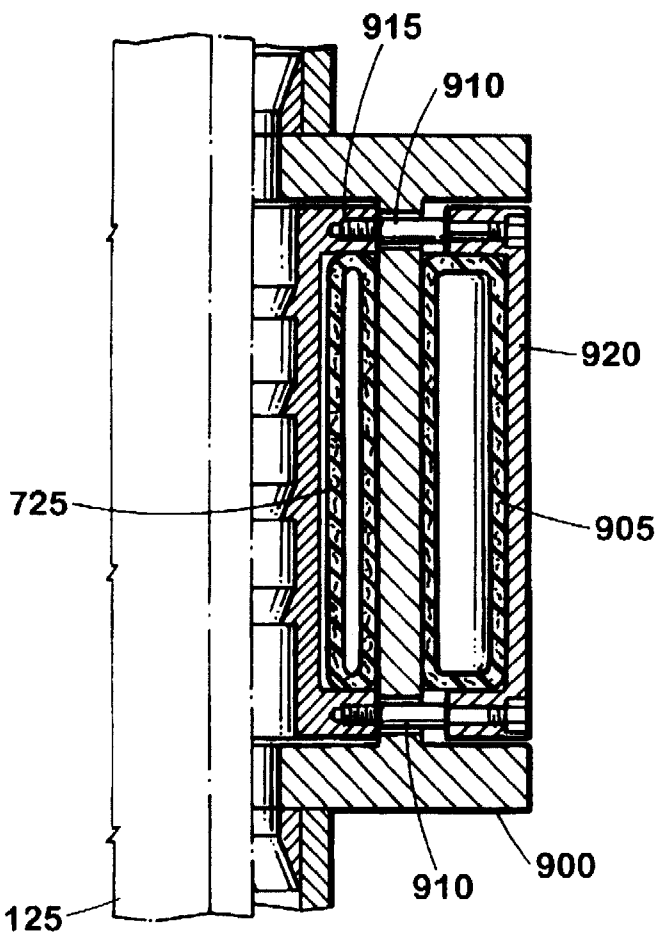

FIG. 9*a* shows, in cross section, another alternative embodiment of a pile gripper in accordance with the invention in the disengaged position. FIG. 9*b* shows the same embodiment in the engaged position.

Figure 10:
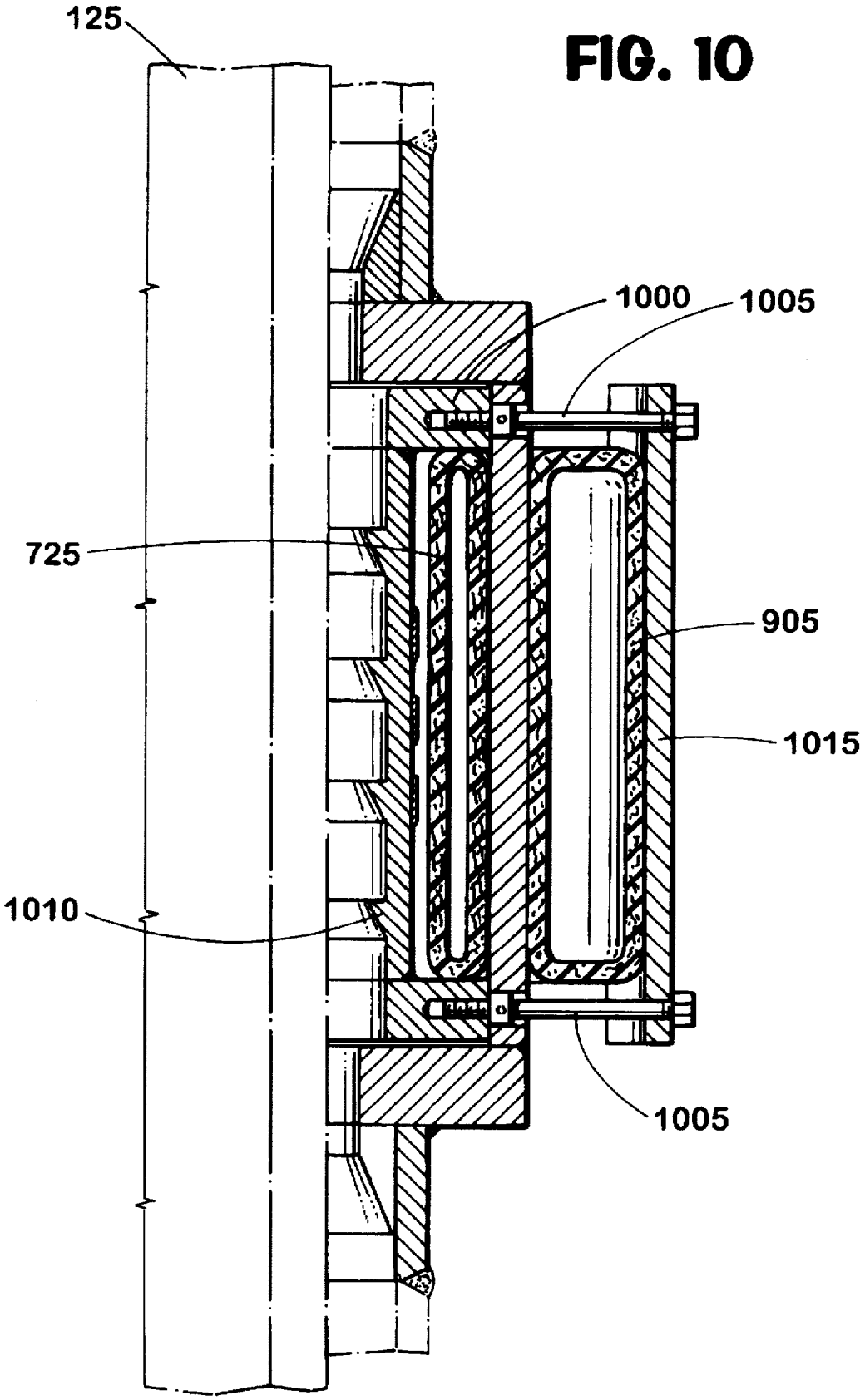

FIG. 10 shows, in cross section, another alternative embodiment of a pile gripper in accordance with the invention.

Figure 11A:
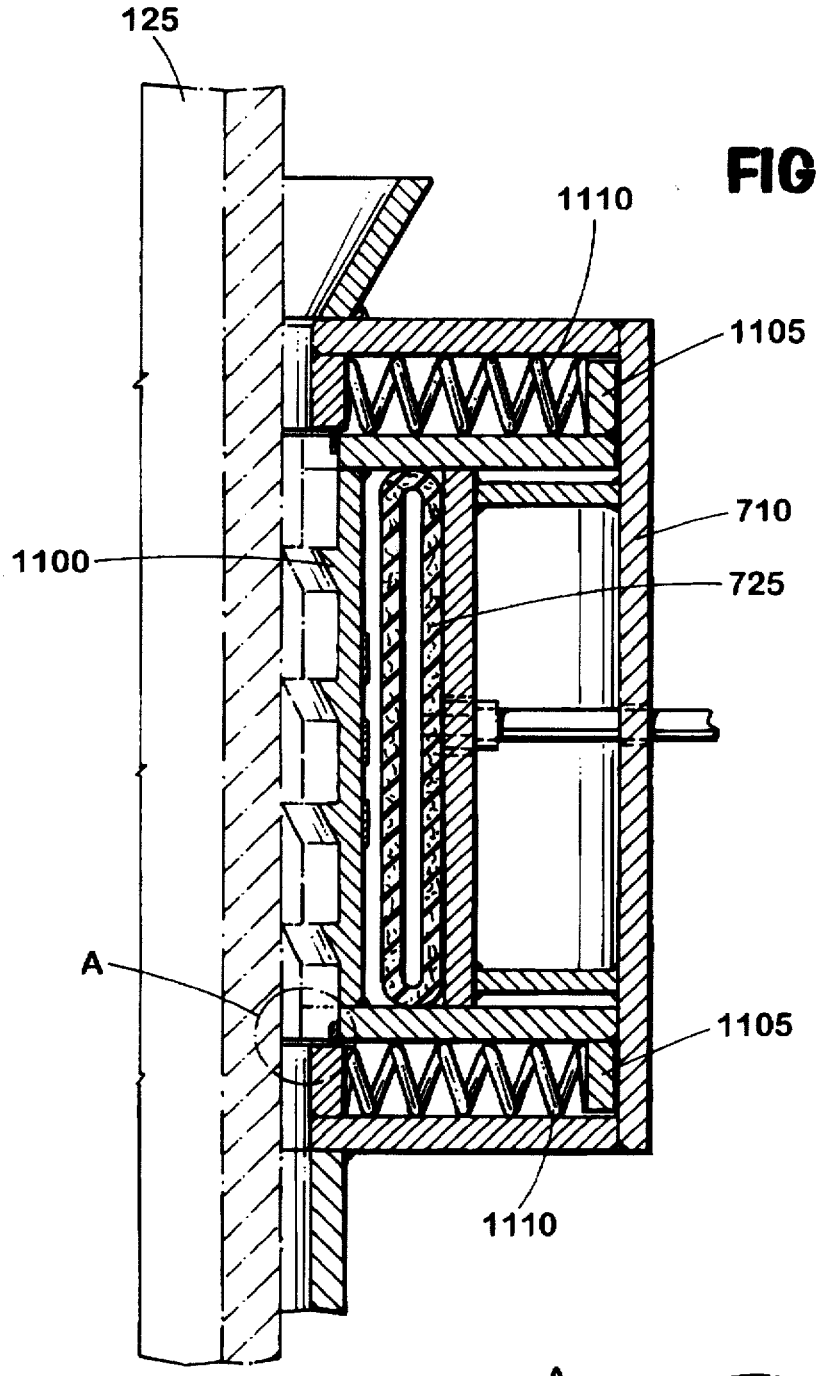
Figure 11B:
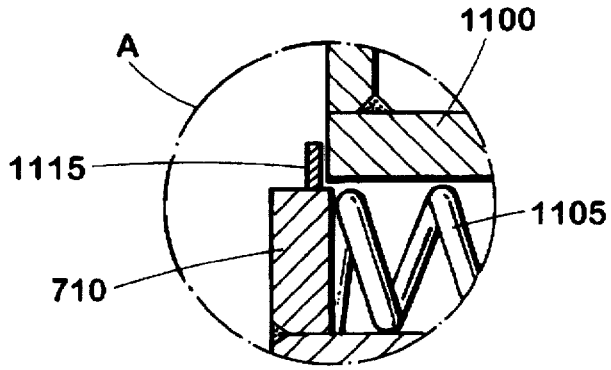

FIG. 11*a* shows, in cross section, another alternative embodiment of a pile gripper in accordance with the invention. FIG. 11*b* shows an expanded view of a shear pin for use in any one of the above embodiments.

4. DETAILED DESCRIPTION OF A SPECIFIC EMBODIMENT

An illustrative embodiment of the invention is described below, followed by a discussion of some possible alternative embodiments. In the interest of clarity, not all features of an actual implementation are described in this specification. It will of course be appreciated that in the development of any such actual implementation (as in any engineering development project), numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking of mechanical engineering for those of ordinary skill having the benefit of this disclosure.

4.1 INTRODUCTION

Figure 1B:
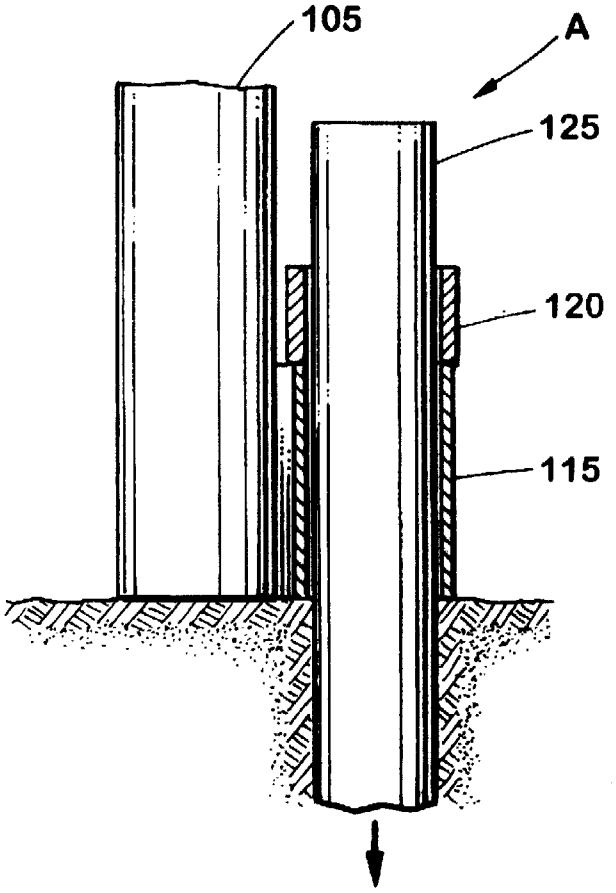
Figure 1A:
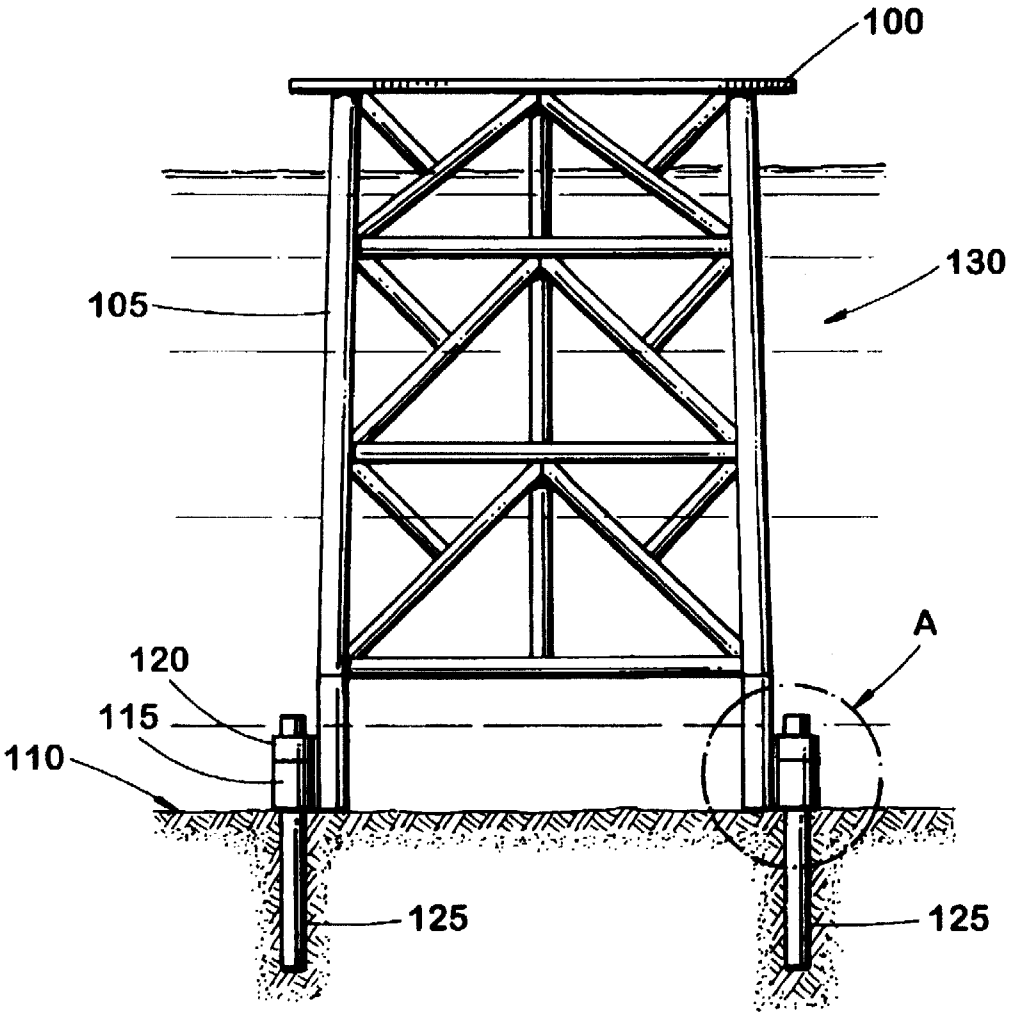
Figure 2:
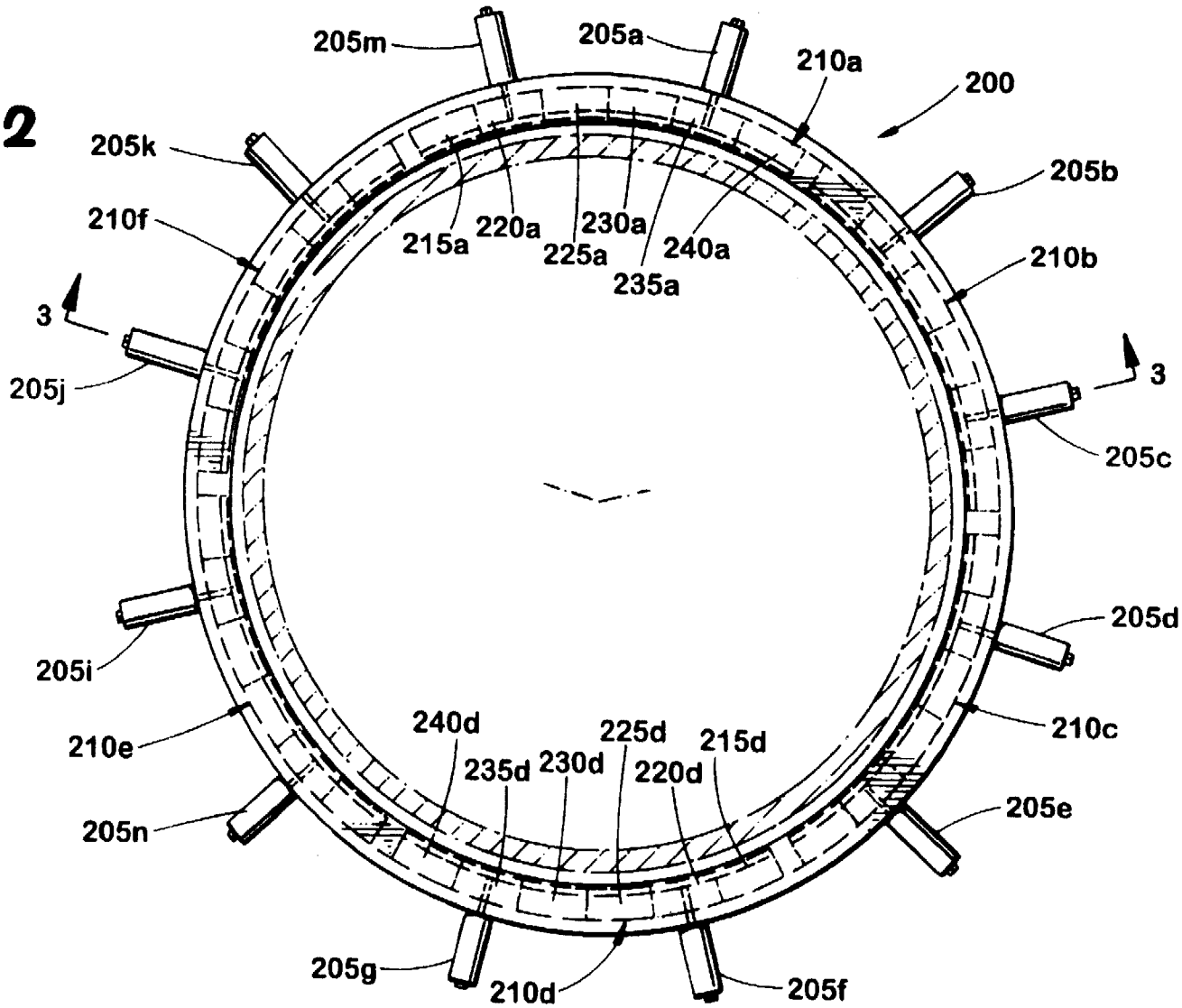
FIG. 2 is a top view of a multi-segmented pile gripper in accordance with the invention.

FIG. 2 shows a top view of an illustrative multi-segmented pile gripper 200 in accordance with the invention. In this embodiment, the pile gripper 200 has an essentially circular cross section allowing a pile (not shown in FIG. 2) to be driven through it, a plurality of evenly spaced spring elements 205 (205*a* through 205*m*), and a number of evenly spaced segment groups 210 (210*a* through 210*f*). Each segment group 210 comprises six segments, e.g., elements 215 (215*a*) through 240 (240*f*). Each segment has a plurality of teeth which are used to "grip" an anchor pile. Further, each segment in a segment group 210 is operatively coupled via resilient joints to the other segments in the segment group. Conceptually, the totality of segment groups form a segmented ring.

The multi-segmented pile gripper 200 has an elastomeric bag (not shown in FIG. 2) which, when inflated, exerts pressure on the backside of the segments causing them to move inward and compress radially to grip the pile. When the elastomeric bag is deflated, the spring elements 205 uniformly retract the segments to disengage the pile gripper.

In the illustrative embodiment described below in text and figures, a multi-segmented pile gripper 200 is designed for a pile having an outside diameter of approximately 60 inches and uses segment groups 210 comprised of six segments, 215 through 240. All dimensions are given in inches and represent typical values. It will of course be recognized that specific dimensions for any given embodiment depends upon many factors such as the load for which the pile gripper is designed and while these design decisions may be complex, their determination would be routine for one of ordinary skill having the benefit of this disclosure.

4.2 SEGMENT AND SEGMENT GROUP STRUCTURE

Figure 3:
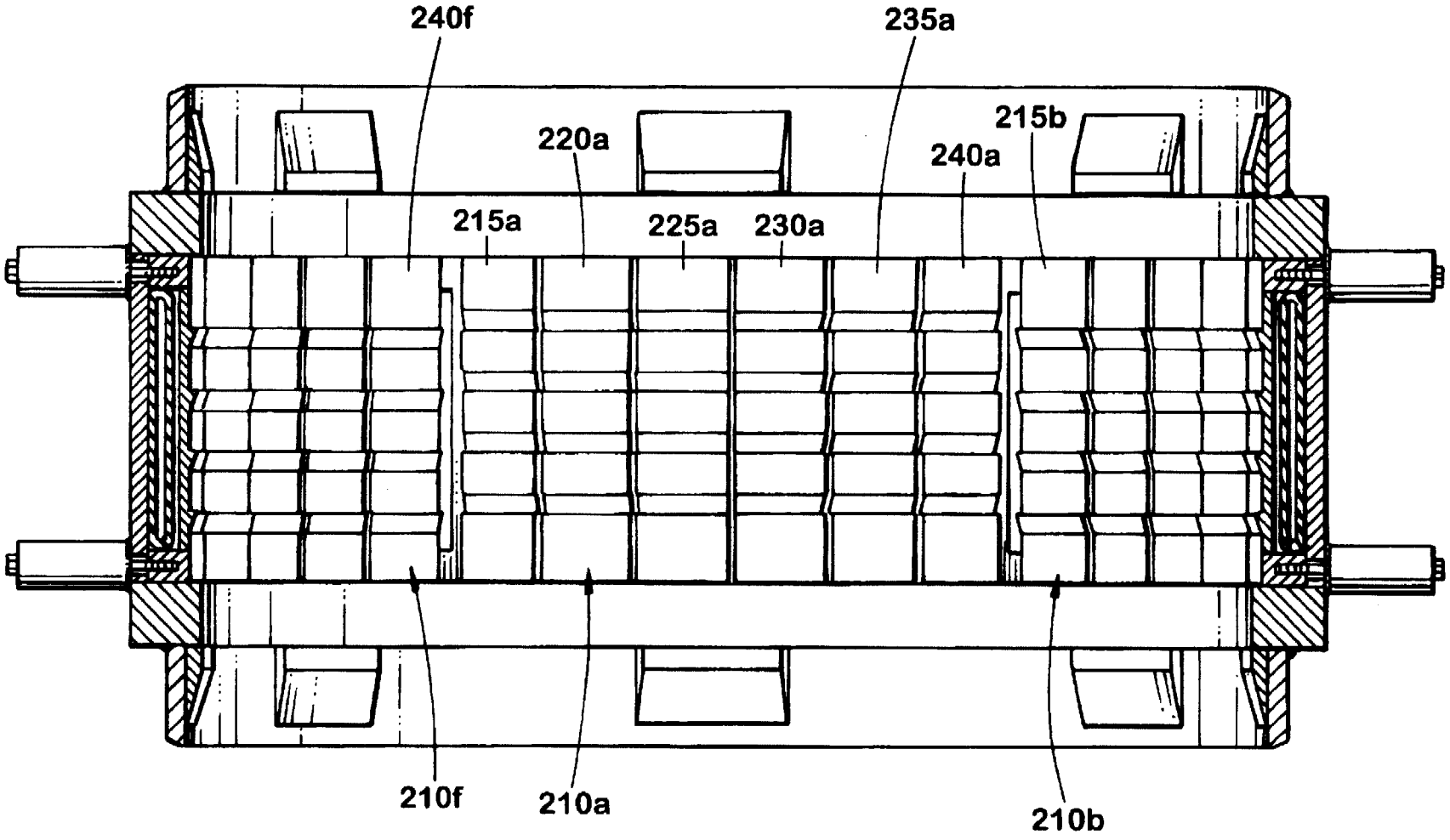
FIG. 3 shows, in cross section, a flat view through section 3—3 of FIG. 2.

In general, each segment group 210 is comprised of a plurality of N segments. One limiting factor on the size of N is the ability of the spring elements 205 (for example, 205*a* and 205*m*) to uniformly retract the segment group (for example, 210*a*) during disengagement. As would be obvious to those of ordinary skill having the benefit of this disclosure, the ability of the spring elements to perform this function is, in turn, a function of the anchor pile's size and the pile gripper's designed axial load. Segment groups can use curved segments whose radii are close to the anchor pile's outside radius. Alternatively, segments can be flat (for ease of manufacture) or have a radius greater than the target pile. FIG. 3 shows, in cross section, a cut through section 3—3 of FIG. 2.

Figure 4:
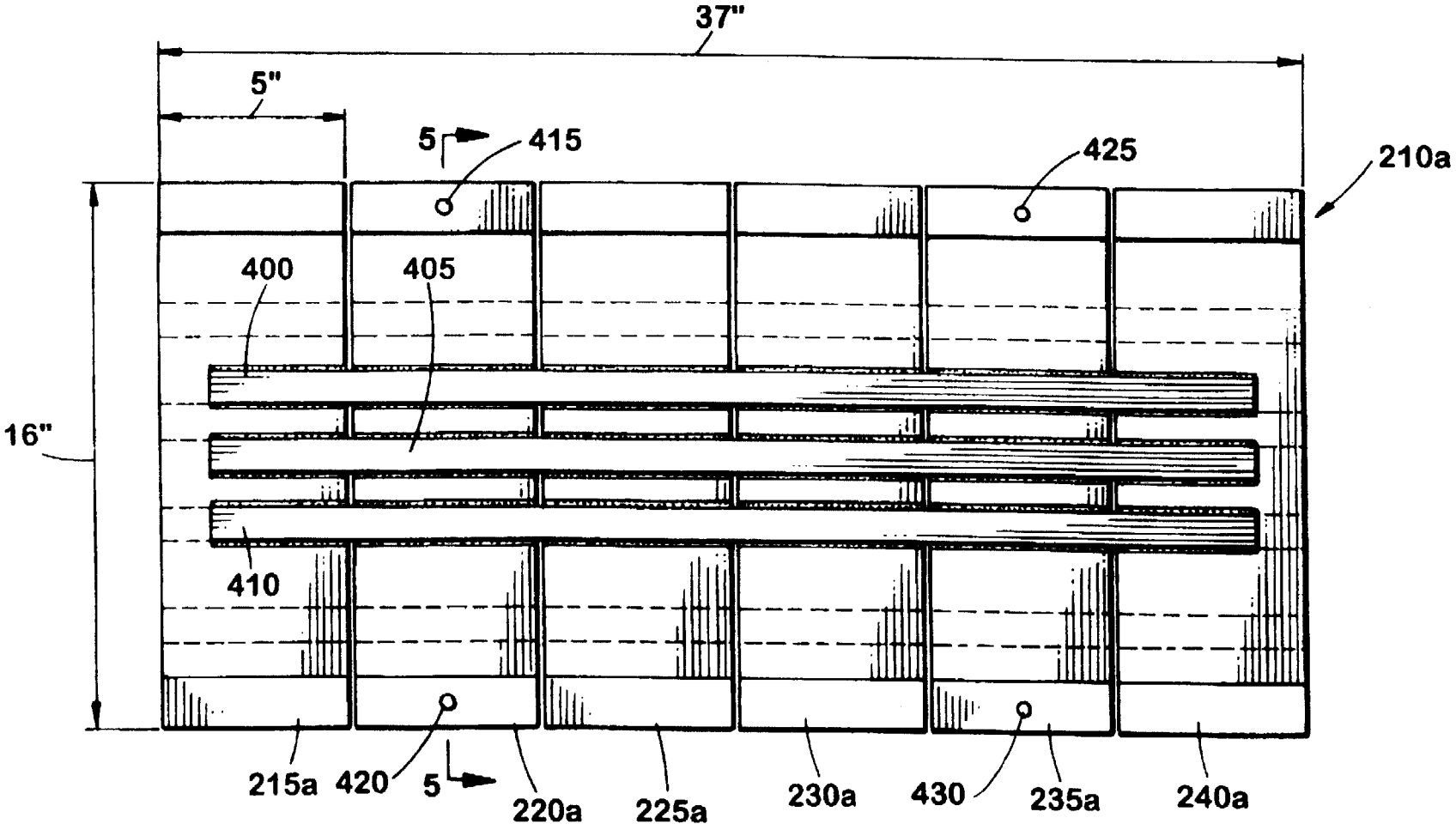
FIG. 4 shows an outside projected view of a segment group in accordance with the invention.

FIG. 4 shows an outside projected view of a single segment group. As shown, the six segments (215*a* through 240*a*) comprising the segment group 210*a* are operatively coupled via three grouping bars 400, 405, and 410. Functionally, the grouping bars provide a resilient interconnection between the segment group's individual segments allowing four spring elements 205 (two on top and two on bottom, see FIGS. 2 and 3) to uniformly retract all six of the groups' segments to disengage the pile gripper. For efficient operation, it is important that the grouping bars be flexible enough to allow the individual segments to move relative to one another as they are engaged and retracted. Holes 415, 420, 425, and 430 for the segment group's spring elements are typically ½ inch–13 UNC in diameter and 1½" (inch) deep. In one embodiment grouping bars are ⅛"×1"×34" plain steel grade plates and are tack welded, top and bottom, to each segment.

Figure 5:
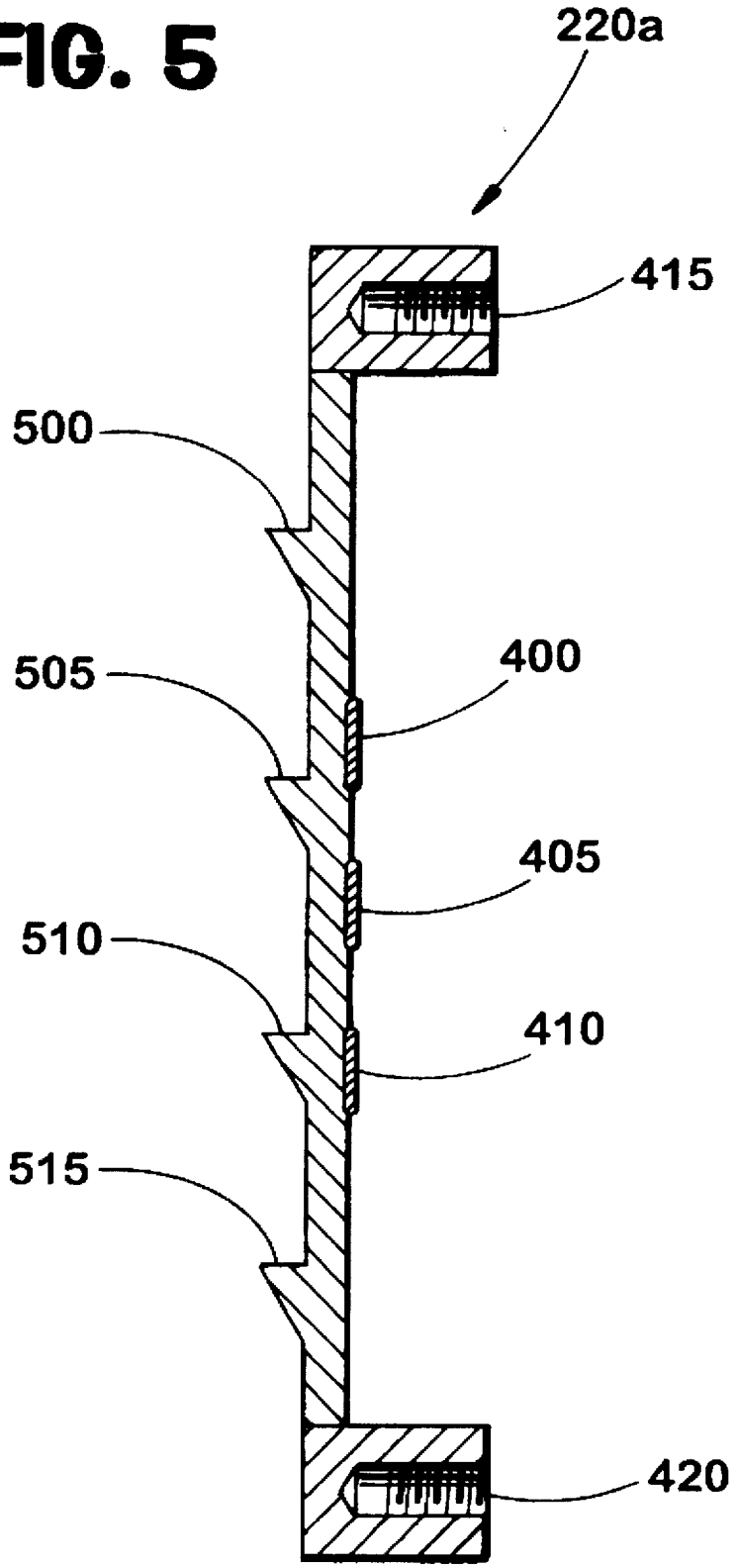
FIG. 5 shows a cross sectional view of a single segment, taken through section 5—5 in FIG. 4.
Figure 6:
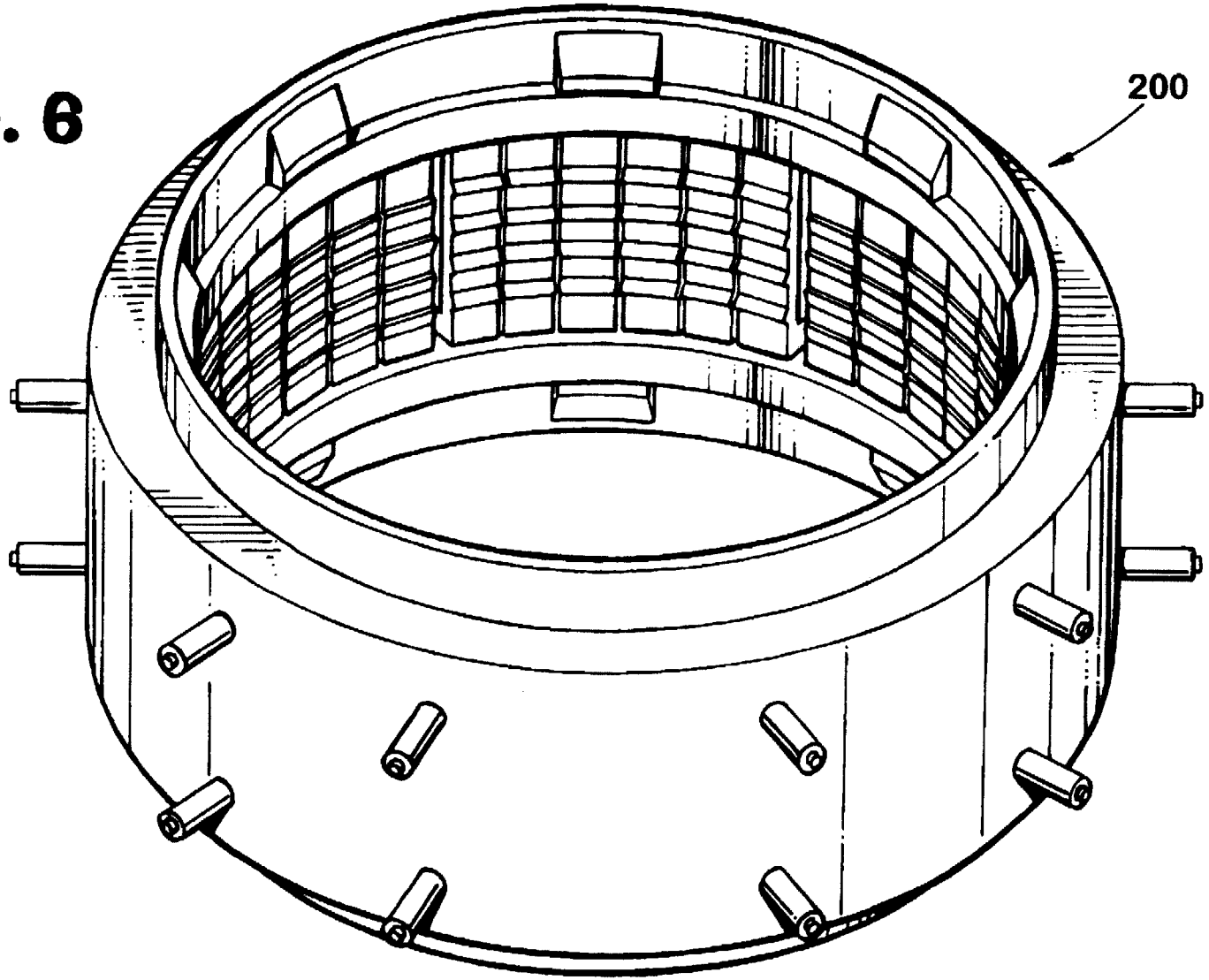
FIG. 6 is an isometric view of a multi-segmented pile gripper in accordance with the invention, and shows the alternating orientation of the pile gripper's teeth from segment group to segment group.

A cross sectional view of a single segment, taken through section 5—5 in FIG. 4 is shown in FIG. 5. While four teeth 500, 505, 510, and 515 are evident in FIG. 5, it would be obvious to those of ordinary skill in the art that the specific number of teeth needed in any application is a function of the pile gripper's designed axial load. Further, since the ability of a segment's teeth to support an axial load is dependent upon their direction, it is advantageous to alternate the direction of the teeth from one segment (or segment group) to the next segment (or segment group). For instance, one segment may have its teeth oriented as shown in FIG. 5, while an adjacent segment has its teeth oriented rotated 180 degrees from that shown in FIG. 5. Alternatively, FIG. 6 provides an isometric view of a multi-segmented pile gripper 200 in accordance with the invention, and clearly shows the alternating orientation of the pile gripper's teeth from segment group to segment group.

4.3 MULTI-SEGMENTED PILE GRIPPER STRUCTURE

A cross sectional view of a multi-segmented pile gripper in the region adjacent to a spring element 205 is shown in FIG. 7. (FIG. 7 could show, for example, any of segments 220*a*, 235*a*, 220*b*, 235*b*, 220*c*, 235*c*, 220*d*, 235*d*, 220*e*, 235*e*, 220*f*, or 235*f*.) In cross section, the illustrative multi-segmented pile gripper comprises a pair of extension rings 700 and 700*a*, a pair of base rings 705 and 705*a*, a hollow containment cylinder 710, spring elements 715 and 720, an elastomeric bag 725, and a segment 730 (arranged circumferentially on the pile 125 side of the containment cylinder). Solid black triangles in FIG. 7 represent weld sites. Each segment 730 is itself comprised of a top flange 735, a bottom flange 740, and a tooth plate 745. Alternatively, the segment may be fabricated from a single metal sheet. In one embodiment, grouping bars 770, 775, and 780 interconnect six segments to form a segment group 210. Typically, the pile gripper 200 is affixed to the jacket's pile sleeve 115 which is often the same type metal as the pile 125.

The combination of base rings 705 and 705*a* and containment cylinder 710 create a groove within which the pile gripper's segments are inserted, e.g., 730. In combination with the containment cylinder 710 the segments create a cavity within which the elastomeric bag 725 is retained. In practice, the elastomeric bag has lugs molded into it which are used to bolt it to the containment cylinder. Similar in concept to a bicycle tire tube, the elastomeric bag 725 is a natural rubber bladder (typically 1 ⅜" thick) wrapped with nylon-reinforced rubber and provided with an inflation hole 780. When inflated, the elastomeric bag 725 exerts pressure on the backside of the segment 730 forcing it inward toward the pile 125. Engaged pressures typically range between 750 pounds-per-square-inch (psi) and 1,000 psi. To disengage the pile gripper 200, the elastomeric bag 725 is deflated allowing the spring elements 715 and 720 to retract the segment's teeth.

In the embodiment shown in FIG. 7, each segment group 210 utilizes four spring elements 205 to retract the segment during disengagement/deactivation. Each spring element 715 or 720 is comprised of a spring guide 750, a spring 755, a flange 760, and a bolt 765. One function of the spring elements 715 or 720 is to uniformly retract the segment group when the elastomeric bag 725 is deflated. Typically, spring elements can provide 0" to 3" of radial movement, although greater movement ranges are easily achievable.

Another function of the spring elements is to support the dead weight of the segment groups during jacket 130 fabrication and installation. Thus, the spring elements may be preloaded to overcome the weight of the segments comprising a segment group. In the embodiment of FIG. 7, springs can be preloaded by threading the bolt 765 into the top flange 735 or bottom flange 740. Those of ordinary skill having the benefit of this disclosure would recognize that the load an individual spring element must support is a function of, among other factors, the number of segments in each group, the pile diameter, and the pile gripper's designed axial load. It will further be known to those of ordinary skill that a typical design will involve an appropriate design margin so that the spring elements' preload tension is more than the minimum necessary to support the attached segments. Alternatively, shear pins may be inserted between each segment (e.g., 730) and the containment cylinder 710 or base rings 705 and 705*a* during fabrication. In this manner, the dead weight of each segment is supported by a shear pins and the spring elements 715 and 720 do not have to be preloaded. The shear pins may be removed after fabrication or broken during a first engagement operation by inflating the elastomeric bag 725 to a sufficiently high pressure as to break them.

Spring elements 205 (specifically 715 and 720) are preferably covered with a cap to provide a means for retaining grease, or similar substance, to minimize corrosion. An additional mechanical shield(s) may also be used to provide physical protection for the spring elements. For example, a welded metal ring above and/or below the spring elements 205 could provide this type of protection. Alternatively, the spring elements 205 could be mounted flush to the pile gripper's containment cylinder 710. That is, perpendicular to that shown in FIGS. 2 through 7.

FIG. 8*a* shows an isometric view of a pile gripper 200 in accordance with the invention wherein the spring elements have been replaced by cable assemblies 800. As shown in FIG. 8*b*, each cable assembly 800 is comprised of a steel cable 805, a guide block 810, a spring sleeve 815, a compression spring 820, and a pulley 825. Cable assemblies 800 are protected by a cover 825 as shown in FIG. 8*a*. FIG. 8*c* shows a detailed view of region denoted as 'A' in FIG. 8*a*, and illustrates how a steel cable 805 is angled by a pulley 830 as it comes out of a segment so that it runs tangential to the gripper's outer surface.

An important benefit of the inventive design is that the segment teeth that perform the gripping action are uniformly engaged (via pneumatic pressure) and retracted (via action of the spring elements or cable assemblies). The combination of uniform segment teeth movement during engagement and disengagement provides significantly more load bearing capability for a specified gripper assembly length or, alternatively, a significantly shorter gripper assembly for a specified load bearing capability than prior art grippers. For example, a gripper designed in accordance with the invention to accommodate a working load of 360 tons (540 ton design load) can be fabricated having a toothed segment height of 14 inches and would weigh approximately 7,050 pounds (3,199 KG). An equivalent prior art gripper, such as the Oil States Industries model D-11772, has a toothed segment height of nearly 47 inches and weighs approximately 11,361 pounds (5,158 KG).

4.4 OPERATION

A multi-segmented pile gripper in accordance with the illustrative embodiment of FIGS. 2 through 7 operates in the following manner. After assembly, the pile gripper is affixed to the sleeve 115 of an offshore platform 100 which, in turn, is affixed to the platform's jacket 130, lowered to the ocean floor, and a pile 125 is driven through the sleeve/gripper combination and into the ocean floor 110. To engage the gripper 200, the elastomeric bag 725 is inflated to a predetermined pressure, typically ranging from 750 psi to 1,000 psi. Constrained by the containment cylinder 710 and segments (e.g., 730), the elastomeric bag expands, forcing each segment to move radially inward until the teeth on each segment embed into the pile 125. Segment teeth engage uniformly along their length.

Once the pile gripper 200 has been activated, it can support an axial load, that is, a load directed along the longitudinal axis of the pile. The gripper 200 transfers the axial load from the jacket 130 to the pile through direct mechanical contact. The load path begins in the offshore leg 105 which is welded to the pile sleeve 115. The pile sleeve 115 is, in turn, welded to the gripper's extension rings 700 and 700*a*. The extension rings 700 and 700*a* transfer the load to the base rings 705 and 705*a*. The base rings 705 and 705*a* transfer the load to the gripper's individual segments (e.g., 730), and the teeth on the individual segments transfer the load into the pile. Each component of the gripper 200 is designed to support load requirements specified by the jacket designers. Because the direction of segment teeth alternate (see FIGS. 6 and 8), the multi-segmented pile gripper is capable of ensuring that the offshore platform 100 cannot move in either direction, up or down.

The multi-segmented pile gripper may also be released and later re-engaged. For instance, the pile gripper may be released to allow the offshore platform 100 to be leveled. A typical leveling operation consists of a series of steps where some of the grippers are engaged while others are released so adjustments can be made. To disengage the multi-segmented pile gripper the elastomeric bag 725 is deflated. Once deflated, the spring elements 205 uniformly retract the segments.

Benefits of a pile gripper in accordance with the invention include its smaller size (for a specified load capability) and therefore its reduced cost, its ability to equally distribute pressure to an anchor/pile, full and equal bidirectional load bearing capacity, and its use of pneumatics (as opposed to more costly and mechanically complex hydraulic systems) for engagement operations.

4.5 SOME ALTERNATIVE EMBODIMENTS

Alternative embodiments of a multi-segment pile gripper that provide both uniform engagement and uniform disengagement of the gripper's teeth include, but are not limited to, the following.

1. Rather than forming the structure of the gripper from a combination of containment cylinder, base rings, and the like as shown in FIG. 7, the gripper's primary structure can be machined from a single ring, and its spring elements may be replaced by a combination of tie rods and an additional elastomeric bag. FIG. 9*a* shows this alternative embodiment in the disengaged position and FIG. 9*b* shows the gripper in the engaged position. In this embodiment, the gripper's primary structure 900 (containment cylinder) comprises a single metal ring that has been machined to provide suitable areas for two elastomeric bags 725 and 905. Tie rods 910 operatively couple the segment 915 (which could be any segment, e.g., 730) to the gripper's structure 900 and a second element 920 that acts to provide a space for the second elastomeric bag 905. To engage, elastomeric bag 725 is inflated and elastomeric bag 915 is deflated, see FIG. 9*b*. To disengage the gripper, elastomeric bag 725 is deflated and elastomeric bag 915 is inflated, see FIG. 9*a*.
2. Another embodiment modifies the structure shown if FIG. 9 and is shown in FIG. 10. In this embodiment, the gripper's primary structure (containment cylinder) is again provided by a single metal ring 1000. Alternatively, element 1000 could be fabricated as in FIG. 7. Tie rods 1005 are operatively coupled to a segment 1010 at one end and a plate 1015 at the other end. The tie rods form the cavity in which the second elastomeric bag 905 is contained.
3. In yet another embodiment, the spring elements are compressed directly by the segments' during gripper engagement. See FIGS. 11*a* and 11*b*. As the elastomeric bladder 725 is inflated, the gripper segment 1100 moves radially toward the pile to engage. As this occurs the segment 1100, through bar 1105 (either a part of, or welded to 1100), causes the spring elements 1110 to be compressed against the containment cylinder 710. When the elastomeric bag 725 is deflated, the spring elements 1110 push the gripper segment 1100 back into its retracted position. Shear pins 1115 are used to ensure the gripper segment 1100 is maintained in the retracted position prior to use. Shear pins 1115 are designed to be easily broken when the elastomeric bag 725 is inflated for the first time.
4. Further, it is noted that each segment may be machined from a single piece of metal, rather than being combined from 3 separate pieces as described above and shown in FIGS. 5 and 7.

It will be appreciated by those of ordinary skill having the benefit of this disclosure that numerous variations from the foregoing illustration will be possible without departing from the inventive concept described herein. Accordingly, it is the claims set forth below, and not merely the foregoing illustration, which are intended to define the exclusive rights claimed in this application.

What is claimed is:

1. A pile gripper for gripping a pile, said pile gripper comprising:

(a) a hollow containment cylinder having an interior surface around an interior region for receiving said pile;

(b) a plurality of segment groups disposed adjacent to the interior surface of said hollow containment cylinder and arranged circumferentially about the interior surface of said hollow containment cylinder, each of said plurality of segment groups having a plurality of gripper segments, and each of said gripper segments having a plurality of teeth on a surface distal from said interior surface of said hollow containment cylinder for gripping said pile;

(c) a retraction mechanism coupling said plurality of segment groups to said hollow containment cylinder; and (d) an engagement device disposed between said hollow containment cylinder and said plurality of segment groups;

wherein the plurality of gripper segments in each of the segment groups are resiliently interconnected for retraction together as a respective group by said retraction mechanism.

2. The pile gripper as claimed in claim 1, wherein said plurality of gripper segments in said each of said plurality of segment groups are resiliently interconnected by at least one respective grouping bar that extends circumferentially with respect to said interior surface of said hollow containment cylinder and that is fastened to more than one of said plurality of gripper segments in said each of said plurality of segment groups.

3. The pile gripper as claimed in claim 1, wherein said plurality of gripper segments in said each of said plurality of segment groups are resiliently interconnected by a respective plurality of grouping bars that extend circumferentially with respect to said interior surface of said hollow containment cylinder, and each grouping bar in said respective plurality of grouping bars is welded to each of said plurality of gripper segments in said each of said plurality of segment groups.

4. The pile gripper as claimed in claim 1, wherein the retraction mechanism has a respective group of spring elements coupled to each segment group for substantially uniform retraction of all of the gripper segments in said each segment group.

5. The pile gripper as claimed in claim 1, wherein the engagement device includes at least one elastomeric bag disposed between the interior surface of the hollow containment cylinder and said plurality of gripper segments of said plurality of segment groups.

6. The pile gripper as claimed in claim 1, wherein said retraction mechanism comprises:

(a) a plurality of plates, one plate for each of said plurality of segment groups;

(b) a plurality of tie-rods operatively coupling said plurality of gripper segments in each of said plurality of segment groups to one of said plurality of plates; and (c) an elastomeric bag disposed between said hollow containment cylinder and each of said plurality of plates.

7. The pile gripper as claimed in claim 1, wherein said retraction mechanism comprises a plurality of springs, each one of said plurality of springs is disposed adjacent to one of said plurality of gripper segments and is wholly internal to said hollow containment cylinder, each one of said plurality of springs has a first and second end wherein said first end is operatively coupled to said one of said plurality of gripper segments, and the second end is operatively coupled to said hollow containment cylinder.

8. The pile gripper as claimed in claim 1, wherein said retraction mechanism comprises a plurality of spring elements, each one of said plurality of spring elements couples one of said plurality of gripper segments to said hollow containment cylinder, and each of said plurality of spring elements extends radially outward from said hollow containment cylinder.

9. The pile gripper as claimed in claim 1, wherein said retraction mechanism comprises a plurality of cable elements, each one of said plurality of cable elements couples one of said plurality of gripper segments to said hollow containment cylinder, and each of said plurality of cable elements penetrates said hollow containment cylinder.

10. The pile gripper as claimed in claim 1, wherein some of said plurality of gripper segments in said plurality of segment groups have said teeth oriented in a first direction and some other of said plurality of gripper segments in said plurality of segment groups have said teeth oriented in a second direction.

11. The pile gripper as claimed in claim 10, wherein said first direction and said second direction are 180 degrees different from one another.

12. A pile gripper for gripping a pile, said pile gripper comprising:

(a) a hollow containment cylinder having an interior surface around an interior region for receiving said pile;

(b) a plurality of segment groups disposed adjacent to the interior surface of said hollow containment cylinder and arranged circumferentially about the interior surface of said hollow containment cylinder, each of said plurality of segment groups having a plurality of gripper segments, and each of said gripper segments having a plurality of teeth on a surface distal from said interior surface of said hollow containment cylinder for gripping said pile;

(c) a retraction mechanism coupling said plurality of segment groups to said hollow containment cylinder; and (d) an engagement device disposed between said hollow containment cylinder and said plurality of segment groups;

wherein the plurality of gripper segments in each of the segment groups are resiliently interconnected for retraction together as a respective group by said retraction mechanism;

wherein said plurality of gripper segments in each of said plurality of segment groups are resiliently interconnected by at least one respective grouping bar that extends circumferentially with respect to said interior surface of said hollow containment cylinder and that is fastened to more than one of said plurality of gripper segments in said each of said plurality of segment groups;

wherein the retraction mechanism has a respective group of spring elements coupled to each segment group for substantially uniform retraction of all of the gripper segments in said each segment group; and wherein the engagement device includes at least one elastomeric bag disposed between the interior surface of the hollow containment cylinder and said plurality of gripper segments of said plurality of segment groups.

13. The pile gripper as claimed in claim 12, wherein the grouping bars are fastened by welding to the gripper segments.

14. The pile gripper as claimed in claim 12, wherein the plurality of gripper segments in each of said plurality of segment groups are resiliently interconnected by a respective plurality of grouping bars that extend circumferentially with respect to said interior surface of said hollow containment cylinder and each grouping bar in said respective plurality of grouping bars is welded to each of said plurality of gripper segments in said each of said plurality of segment groups.

15. The pile gripper as claimed in claim 12, wherein said retraction mechanism comprises:

(a) a plurality of plates, one plate for each of said plurality of segment groups;

(b) a plurality of tie-rods operatively coupling said plurality of gripper segments in each of said plurality of segment groups to one of said plurality of plates; and (c) an elastomeric bag disposed between said hollow containment cylinder and each of said plurality of plates.

16. The pile gripper as claimed in claim 12, wherein said retraction mechanism comprises a plurality of springs, each one of said plurality of springs is disposed adjacent to one of said plurality of gripper segments and is wholly internal to said hollow containment cylinder, and each one of said plurality of springs has a first and second end wherein said first end is operatively coupled to said one of said plurality of gripper segments, and the second end is operatively coupled to said hollow containment cylinder.

17. The pile gripper as claimed in claim 12, wherein said retraction mechanism comprises a plurality of spring elements, each one of said plurality of spring elements couples one of said plurality of gripper segments to said hollow containment cylinder, and each of said plurality of spring elements extends radially outward from said hollow containment cylinder.

18. The pile gripper as claimed in claim 12, wherein said retraction mechanism comprises a plurality of cable elements, each one of said plurality of cable elements couples one of said plurality of gripper segments to said hollow containment cylinder, and each of said plurality of cable elements penetrates said hollow containment cylinder.

19. The pile gripper as claimed in claim 12, wherein some of said plurality of gripper segments in said plurality of segment groups have said teeth oriented in a first direction and some other of said plurality of gripper segments in said plurality of segment groups have said teeth oriented in a second direction.

20. The pile gripper as claimed in claim 19, wherein said first direction and said second direction are 180 degrees different from one another.

21. A pile gripper for gripping a pile, said pile gripper comprising:

(a) a hollow containment cylinder having an interior surface around an interior region for receiving said pile;

(b) a plurality of segment groups disposed adjacent to the interior surface of said hollow containment cylinder and arranged circumferentially about the interior surface of said hollow containment cylinder, each of said plurality of segment groups having a plurality of gripper segments, each of said gripper segments having a plurality of teeth on a surface distal from said interior surface of said hollow containment cylinder for gripping said pile;

(c) a retraction mechanism coupling said plurality of segment groups to said hollow containment cylinder; and (d) an engagement device disposed between said hollow containment cylinder and said plurality of segment groups;

wherein the plurality of gripper segments in each of the segment groups are resiliently interconnected for retraction together as a respective group by said retraction mechanism;

wherein said plurality of gripper segments in each of said plurality of segment groups are resiliently interconnected by a plurality of grouping bars that extend circumferentially with respect to said interior surface of said hollow containment cylinder and that are welded to said plurality of gripper segments in said each of said plurality of segment groups;

wherein the retraction mechanism has a respective group of spring elements coupled to each segment group for substantially uniform retraction of all of the gripper segments in said each segment group;

wherein the engagement device includes at least one elastomeric bag disposed between the interior surface of the hollow containment cylinder and said plurality of gripper segments of said plurality of segment groups; and wherein some of said plurality of gripper segments in said plurality of segment groups have said teeth oriented in a first direction and some other of said plurality of gripper segments in said plurality of segment groups have said teeth oriented in a second direction.

22. The pile gripper as claimed in claim 21, wherein said first direction and said second direction are 180 degrees different from one another.

* * * * *